US005797158A

United States Patent [19]

Hoshizaki et al.

[11] Patent Number: 5,797,158

[45] Date of Patent: Aug. 25, 1998

[54] TOOTHBRUSH

[76] Inventors: Hisakata Hoshizaki, c/o Johnson & Johnson K.K. Dormitory 1-4 1, Aza Meotozaka, Oh-aza Ohkanbara, Sukagawa-shi, Fukushima-ken; Takayuki Watanabe, 9-6 Aza Shoubuzawa, Oh-aza Odakura, Nishigou-mura, Nishishirakawa-gun, Fukushima-ken, both of Japan

[21] Appl. No.: 844,964

[22] Filed: Apr. 23, 1997

Related U.S. Application Data

[63] Continuation of Ser. No. 700,601, Aug. 12, 1996, abandoned, which is a continuation of Ser. No. 342,518, Nov. 21, 1994, abandoned.

[51] Int. Cl.[6] ..... A46B 9/04

[52] U.S. Cl. ..... 15/167.1; 15/191.1

[58] Field of Search ..... 15/167.1, 195, 15/191.1; 132/88.7

[56] References Cited

U.S. PATENT DOCUMENTS

| | | | |
|---|---|---|---|
| 4,404,977 | 9/1983 | Vasas | 132/88.7 |
| 4,475,261 | 10/1984 | Okumura | 15/195 |
| 4,646,381 | 3/1987 | Weihrauch | 15/167.1 |
| 4,741,066 | 5/1988 | Ito | 15/195 |
| 5,305,492 | 4/1994 | Giuliani | 15/167.1 |

*Primary Examiner*—Randall Chin

[57] ABSTRACT

A toothbrush having a block head with bristles embedded in tuft holes by flat bars, a block handle for holding said toothbrush, and an elongated neck portion connecting said block head with said block handle, wherein said block head is at least 3 mm but at most 4 mm in thickness, the length from the bottoms of said tuft holes to a reverse surface of said block head is at least 0.2 mm but at most 2.2 mm, said tuft holes are 1.8 mm or more in depth and said toothbrush is formed of a polyacetal resin.

4 Claims, 3 Drawing Sheets

TOOTHBRUSH

This is a continuation of application Ser. No. 08/700,601, filed Aug. 12, 1996, now abandoned which is a continuation of application Ser. No. 08/342,518, filed Nov. 21, 1994, now abandoned which are hereby incorporated by reference.

FIELD OF THE INVENTION

This invention relates to a toothbrush, and more specifically it relates to a toothbrush formed of a polyacetal resin, having a thin block head, excelling in mechanical strength, fatigue strength and durability and having good oral handleability.

PRIOR ART

With increasing interest in oral hygiene in recent years, a toothbrush has been required which is so excellent in oral handleability as to be able to thoroughly clean the inside of the mouth including portions that have been so far hardly brushed, such as insides of molars, etc. in particular. To meet this requirement, there has been a tendency to make the block head thinner and smaller.

In producing the toothbrush, a method of embedding bristles an important step, i.e., a method of fixing plural filaments in tuft holes to form tufts, includes a method using flat bars, a method of embedding the filaments with a resin, and so forth. Of these, the method using flat bars has been widely employed because the embedding operation is simple, the tufts can be surely fixed, and so forth. The flat bars here referred to are bar-like or nearly rectangular metallic members which are made of a harder metal than a material of a toothbrush handle and have a size being a bit larger than a diameter of the tuft holes. The method using such flat bars is a method in which the plural filaments being embedded are bent into two, and the flat bars are placed into the bent portions and fixed by being inserted into the tuft holes together with the filaments by a strong force, thereby fixing the bundle of the filaments in the tuft holes. When such step is employed, a scar results when inserting the flat bars remains in walls of the tuft holes. The scar is considered to cause breakage of the block head in the toothbrush in the embedding step or breakage of the block head during brushing.

For this reason, if the thickness of the block head is forcibly decreased, there is a likelihood that problems will occur, such as breakage of the block head in embedding, breakage of the block head during brushing due to fatigue of the material in long-term use, and the like. When the toothbrush is broken during brushing, fingers or the oral cavity are likely to be damaged; it is thus dangerous. Moreover, when the block head is cracked and split in embedding, decrease in yield of the product results. Consequently, in selecting the material of the toothbrush and designing the shape of the block head, especially the thickness of the block head, the depth of the tuft holes, etc., great care must be taken in consideration of safety so as not to entail such dangers.

Styrenic resins such as polystyrene, an acrylonitrile-styrene resin, an ABS resin, etc. have been so far used as a material of the toothbrush handle. Resins having excellent mechanical strength have been lately used also, examples thereof being polymethylpentene described in Japanese Laid-open Patent Appln. (Kokai) No. 24906/1988, cellulosic resins such as a cellulose-acetate-propionate resin marketed from Eastman Kodak and cellulose acetate, a polycarbonate-ABS resin, a polycarbonate-polyethylene terephthalate (PET-PCT copolyester) resin described in Japanese Laid-open Patent Appln. (Kokai) No. 15411/1993, nylons, etc.

With these ordinary resins, the thickness of the block head has to be usually 5–6 mm to prevent the dangers such as the cracking in embedding, the breakage during brushing, etc. In a toothbrush having the thinnest block head, a thickness exceeding 4 mm is at least required. A toothbrush with a block head having a thickness of 4 mm or less has not been hitherto put to practical use.

In order to make everyday brushing comfortable, however, the lower the thickness of the toothbrush block head the better. There is thus a strong demand for a toothbrush with a block head having a thickness of 4 mm or less. Moreover, considering characteristics of the toothbrush as a necessity in the modern life that is used every day, or several times a day, the toothbrush cannot be used comfortably each time unless oral handleability is good. If, to this end, the thickness of the block head is decreased and suitable resiliency is given to the neck portion in particular, the toothbrush becomes properly flexible in the mouth at the time of brushing, thus improving handleability. It is thus advisable that the material is properly resilient.

Resin used to date have deteriorated owing to a flavor ingredient in a dentifrice, so that the block head of the toothbrush is at times split. Especially in the ABS resin, polycarbonate, polyethylene terephthalate, etc., such phenomenon has been known. As the toothbrush is commonly used with the dentifrice, resistance to dentifrice is required. On top of that, if heat resistance that endures heat sterilization is provided, it is hygienically desirous. The resins so far used as the material of the toothbrush have, however, merits and demerits, and a resin that satisfies the above conditions required of the toothbrush has been unknown.

This invention has been made in view of such circumstances. It is an object of this invention to provide a toothbrush having a thinner block head than the ordinary toothbrush, being rich in resiliency and mechanical strength, excelling in chemical resistance and heat resistance and being good in appearance.

SUMMARY OF THE INVENTION

To achieve the aforesaid object, this invention is to provide a toothbrush having a block head 3 with bristles embedded in tuft holes 4 by flat bars, a block handle 1, for holding said toothbrush, and an elongated neck portion 5, connecting said block head with said block handle, wherein said block head has a thickness (T) of at least 3 mm but at most 4 mm, the length (L) from the bottoms 4*a* of said tuft holes to a reverse (or bottom) surface 6 of said block head is at least 0.2 mm but at most 2.2 mm, and said toothbrush is formed of a polyacetal resin. The toothbrush of this invention have features that result from use of polyacetal, the neck portion is elongated to give the neck portion resiliency so as to improve handleability and prevent breakage of the toothbrush block head in embedding, chemical resistance is so good as not to cause deterioration by a chemical action with a flavor ingredient in a dentifrice, heat resistance is excellent and heat sterilization is enabled.

The polyacetal resin as a material of the toothbrush in this invention is a resin which is excellent in mechanical strength, rigidity, spring characteristics, creep resistance, fatigue strength to repeated stress and chemical resistance, and which finds wide acceptance as engineering plastics. An example of its use as a toothbrush has been hitherto unknown. Such polyacetal means a resin containing formaldehyde or trioxane as a main starting material and having a polyoxymethylene structure, and includes a homopolymer having only the polyoxymethylene structure and a copolymer with ethylene oxide, dioxolane, butanediol formal or the like. These polymers are all available in this invention. Especially preferable in the toothbrush of this invention are various types of polyacetal available under the trademark "Delrin"(E.I. du Pont de Nemours & Co., Inc.), for example.

In this invention, the material of the filaments to form the bristles can be any material ordinarily used in the toothbrush. Examples thereof are polybutylene terephthalate, polyethylene terephthalate, polyamide, polypropylene, vinylidene chloride, polyvinyl chloride, polyurethane and the like.

The thickness T (as shown in FIG. 2A) of the block head of the block handle in the toothbrush of this invention is at least 3 mm but at most 4 mm, preferably at least 3.1 mm but at most 3.8 mm. When it is less than 3 mm, the block head tends to be broken in embedding. When it exceeds 4 mm, a quite comfortable feeling is not given in using the toothbrush at the time of brushing.

The length L (as shown in FIG. 2A) from the bottoms of the tuft holes to the reverse surface of the block head in the toothbrush of this invention is at least 0.2 mm but at most 2.2 mm, preferably at least 0.25 mm but at most 1.8 mm. When it is less than 0.2 mm, strength of the block head is not sufficient, causing breakage of the block head in embedding and the like. When it exceeds 2.2 mm, the thickness of the block head is increased, making it impossible to provide the comfortable use feeling aimed at by this invention.

The depth D (as shown in FIG. 2A) of the tuft holes in the toothbrush of this invention is 1.8 mm or more, preferably 1.9 mm or more, especially preferably 2.0 mm or more. When it is less than 1.8 mm, embedding becomes difficult; even when embedding can be carried out, standing of the bristles becomes undesirably uneven. The diameter of the tuft hole in the toothbrush of this invention is not particularly limited. It is preferably at least 1.5 mm but at most 1.7.

The block handle of the toothbrush in this invention can be produced by molding the polyacetal resin by a known method such as injection molding or the like. The toothbrush can be formed by embedding the filaments in the block head through the flat bars in a known manner.

EXAMPLES

Example 1

Figure 1:
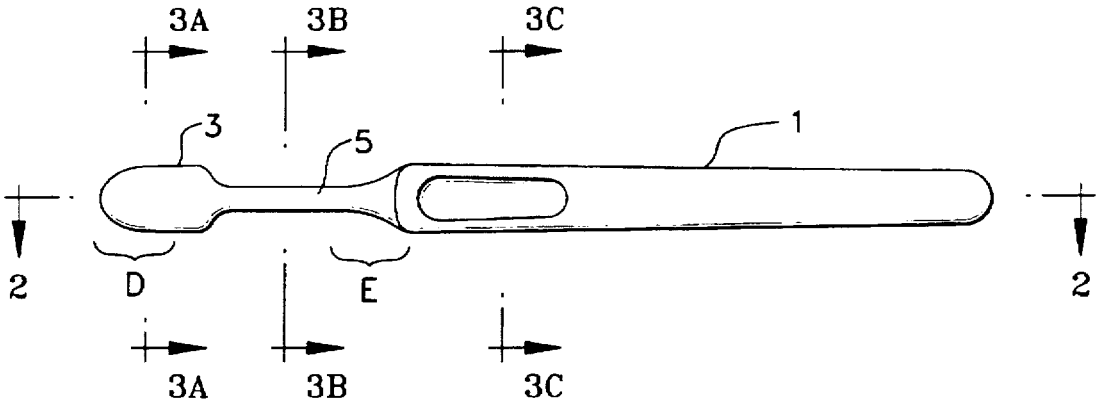
FIG. 1 is as front view of a sample toothbrush used for evaluation in a test for flexural strength of a neck portion, a test for rapid curving of a neck portion, an embedding test, a test for heat resistance and a test for resistance to dentifrice in the toothbrush of this invention.
Figure 3A:
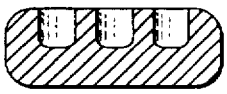
FIG. 3 (*a*), (*b*) and (*c*) are enlarged sectional views of the end surface taken along lines A—A, B—B and C—C in FIG. 1, respectively.
Figure 3B:
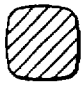
Figure 3C:
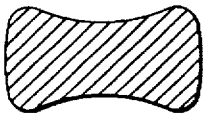
Figure 2:
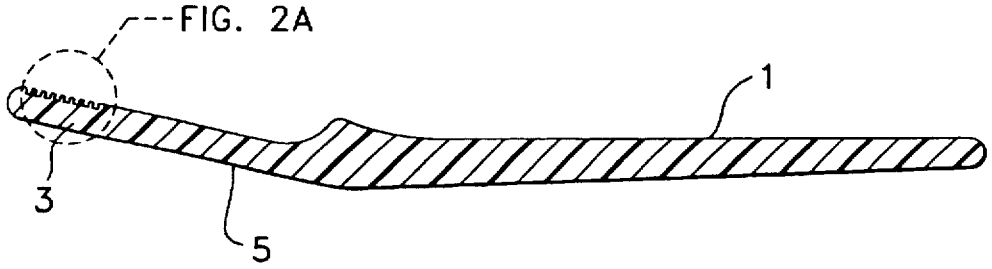
FIGS. 2 and 2A shows cross-sectional views of the above toothbrush.
Figure 2A:
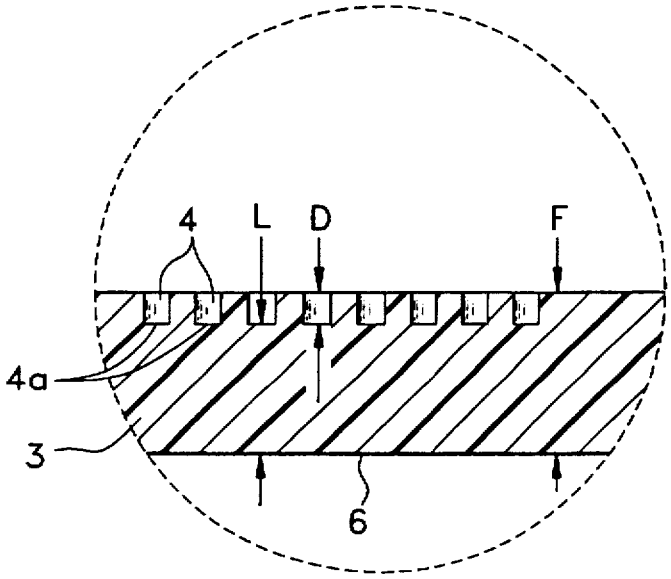
Figure 4:
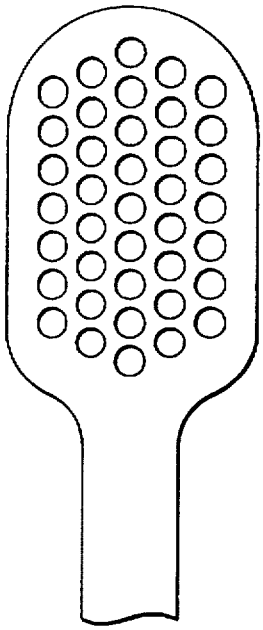
FIG. 4 is an enlarged front view of a bristle embedded surface of a block head in the toothbrush shown in FIG. 1.

As samples for an embedding test, toothbrushes shaped as shown in FIG. 1 and having an arrangement of tuft holes (a diameter of the tuft hole: 1.6 mm) shown in FIG. 4 were formed by injection-molding polyacetal ("Delrin 100P": a trademark for a product of E.I. du Pont de Nemours & Co., Inc.), polypropylene ("Novatek 4506J": a trademark for a product of Mitsubishi Chemical Industries Ltd.), a cellulosic resin ("Tenite Propionate": a trademark for a product of Eastman Kodak) and a PET-PCT copolymer ("KODAR PET-G 6763": a trademark for a product of Eastman Kodak). In said toothbrushes, there were provided a total of 6 types of handles having block heads with their thicknesses varied by 1 mm from 2 mm to 7 mm.

As the embedding test, 20±3 pieces of polybutylene terephthalate filaments (a diameter: 0.20 mm) were embedded in all these tuft holes. The number of the tuft holes that were cracked or whitened (i.e., showed a white area or line visually indicating that the area or line had been stressed ) on this occasion was visually observed, and the ratio was evaluated. The results of the evaluation are shown in Table 1.

TABLE 1

Occurrence of abnormality of block head (%)

| | Thickness of a block head (mm) | | | | | |
|---|---|---|---|---|---|---|
| Resin | 2 mm | 3 mm | 4 mm | 5 mm | 6 mm | 7 mm |
| Polypropylene | 100 | 87 | 32 | 10 | 0 | 0 |
| Cellulosic resin | 81 | 53 | 16 | 8 | 0 | 0 |
| PET PCT copolyester | 100 | 60 | 10 | 5 | 0 | 0 |
| Polyacetal | 21 | 0 | 0 | 0 | 0 | 0 |

Table 1 reveals that in the toothbrushes made of polypropylene, PET-PCT copolyester and cellulosic resin, 10% abnormality in embedding occurs in the block head 5 mm in thickness and the thickness of at least 6 mm is necessary for preventing abnormality in embedding. On the other hand, in the handle made of polyacetal, occurrence of abnormality in embedding can sufficiently be prevented with the thickness of 3 mm.

Example 2

Toothbrush handles shaped as shown in FIG. 1 and having 3.5 mm thick block heads were formed by injection molding polypropylene, a PET-PCT copolyester, a cellulosic resin and polyacetal as in Example 1. Using the thus formed toothbrush handles as samples, the test for heat resistance was run by the following method.

Two constant temperature devices (a blowing constant temperature device DN-63 manufactured by Yamato Kagaku K.K.) were set at 200° C. and 100° C. respectively. In these constant temperature devices, five toothbrush handles as samples were allowed to stand for each material, and appearance was visually observed at 200° C. after 5 minutes and at 100° C. after 15 minutes.

As a result of this test, it was observed that the five handles made of each of the PET-PCT copolyester and the cellulosic resin were all deformed at 200° C. after 5 minutes from the start of the test. Likewise, the five handles were all deformed also at 100° C. after 15 minutes. On the other hand, it was observed that the handles made of polyacetal were not deformed at either 200° C. or 100° C. The results of the test reveal that the toothbrush handles made of polyacetal have higher heat stability than the toothbrush handles made of the PET-PCT copolyester and the cellulosic resin, and are stable at 100° C. or higher in particular. This shows that the toothbrush handles of this invention are not deformed even by heat sterilization and are hygienically desirable.

Example 3

Toothbrushes shaped as shown in FIG. 1 and having an arrangement of tuft holes (a diameter: 1.6 mm) shown in FIG. 4 were formed of the polypropylene, cellulosic, PET-PCT copolyester and polyacetal resins used in Example 1. In the block heads of the toothbrush handles, 20±3 pieces of polybutylene terephthalate filaments (a diameter: 0.2 mm) were embedded to form samples in a test for resistance to dentifrice.

For each resin, five sample toothbrushes were allowed to stand in a 10% dentifrice aqueous solution for three months, and appearance of the handles was visually observed every one week.

As a result of the test for resistance to dentifrice, it was found that after one week from the start of the test, meshy surface crack called crazing occurred in the vicinity of the block head in the handle made of the PET-PCT copolyester. Meanwhile, even if the toothbrushes made of polypropylene, cellulosic resin and polyacetal were allowed to stand for three months, no abnormality occurred in their appearance.

The results of this test show that the handle of the PET-PCT copolyester is poor in chemical resistance and the material becomes deteriorated, when used with the dentifrice, by the flavor ingredient of said dentifrice, etc. On the other hand, in the toothbrushes made of the other resins including polyacetal, no deterioration of the material was observed in appearance, nor was abnormality such as breakage of the toothbrush block head or the like seen.

Example 4

Toothbrush handles shaped as shown in FIG. 1 and having 3.5 mm thick block heads were formed by injection-molding polypropylene, a PET-PCT copolyester, cellulosic resin and polyacetal as in Example 1.

Using the thus formed toothbrush handles, a test for flexural strength of a neck portion and a test for rapid curving of a neck portion were carried out.

(1) Test for Flexural Strength of a Neck Portion

Figure 5:
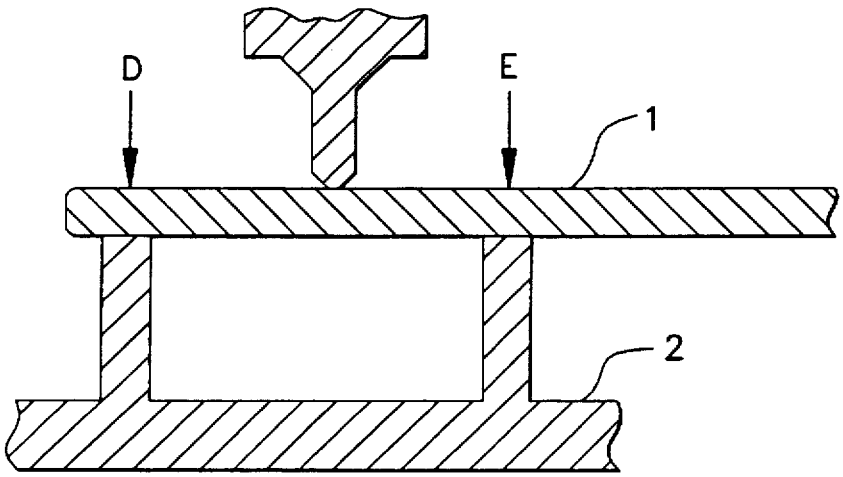
FIG. 5 is a view explaining a method of a test for flexural strength of a neck portion. Description of numerals: 1=toothbrush handle; 2=fixing base.

As illustrated in FIG. 5, a block head D of the toothbrush handle and a connecting portion E of the neck portion and the block handle were fixed on a fixing base 2. Under test conditions of a humidity of 65% ±3% and a temperature of 20°±1° C., a load was exerted on a center between said D and E using an autograph AGS-100B model manufactured by Shimadzu Corporation. When the toothbrush handle yielded or was broken and destroyed, a load was measured at that time. The measurement was conducted five times for each resin sample, and an average of the measured values was taken. The results are shown in Table 2.

TABLE 2

| Resin | Strength (kg) | Remarks |
|---|---|---|
| Polypropylene | 19.2 ± 1.0 | All the handles are whitened |
| Cellulosic resin | 7.9 ± 1.1 | The handles only yield |
| PET-PCT copolymer | 11.7 ± 0.8 | All the handles are cracked |
| Polyacetal | 30.0 ± 1.2 | The handles only yield |

In the handle made of polypropylene, the neck portion is curved with the increasing load. As shown in Table 2, however, when the load exceeds 19.2±1.0 kg, the handle is whitened (i.e.,shows a white area or line visually indicating that the area or line had been stressed) and destroyed. In the toothbrush made of the PCT copolyester, the neck portion is curved with the increasing load. When the load of 11.7±0.8 kg is exerted, the toothbrush is completely curved and the neck portion is cracked. In the toothbrush made of the cellulosic resin, when the load of 7.9±1.1 kg is exerted, the neck portion of the toothbrush is completely curved and its shape is not restored. Meanwhile, in the handle made of polyacetal, when the load exceeds 30.0±1.2 kg, the neck portion of the handle is completely curved, but the handle is not broken or destroyed.

The above test results show the following. The toothbrushes made of polypropylene, the PET-PCT copolyester and the cellulosic resin have lower flexural strength in yielding than the toothbrush made of polyacetal. The toothbrush made of polypropylene is whitened in yielding, and the toothbrush made of the PET-PCT copolyester is cracked in yielding, having an adverse effect on the resin. By contrast, the toothbrush made of polyacetal has the very strong neck portion. Even though excess force is exerted during brushing, said toothbrush is only curved and safe without being broken and destroyed. To provide practical strength, the toothbrush made of polyacetal can be rendered thinner than the toothbrushes made of the other materials.

(2) Test for Rapid Curving of Neck Portion

The block head and the block handle of the toothbrush shaped as shown in FIG. 1 were held with hands, and the handle was rapidly curved in this state. Test persons were five general consumers, and the test was run once for each of the toothbrushes made of polypropylene, the PET-PCT copolyester, cellulosic resin and polyacetal.

As a result, three of the five handles made of polypropylene were broken, and the remaining two were also whitened in the neck portions. Further, the neck portions of the toothbrush handles made of the PET-PCT copolyester and cellulosic resin were both completely curved, and restoration of their shapes was not observed. By contrast, the neck portion of the toothbrush handle made of polyacetal was curved according to the force but not broken. Even after the force was released, the shape of the neck portion was restored, and remained curved only slightly. No other abnormality was observed.

The above two test results reveal that to obtain the same strength, the neck portion of the toothbrush made of polyacetal can be more elongated than those of the toothbrushes made of polypropylene, the PET-PCT copolyester and cellulosic resin, that this results in good handleability within the mouth, for example, on molars or reverse sides of teeth, and that the toothbrush formed of polyacetal is quite excellent to keep teeth and gums in good condition.

The results of the above five tests are shown in Table 3. From Table 3, it reveals that polyacetal alone gives the good results in all the five tests.

TABLE 3

| | Tests | | | | |
|---|---|---|---|---|---|
| Resin | Embedding test | Test for heat resistance | Resistance to dentifrice | Flexural strength of a neck portion | Rapid curving of a neck portion |
| Polyacetal | O | O | O | O | O |
| Polypropylene | X | O | O | X | X |
| Cellulosic resin | X | X | O | X | X |
| PET-PCT copolymer | X | X | X | X | X |

Example 5

Toothbrushes shaped as shown in FIG. 1 and having an arrangement of tuft holes shown in FIG. 4 were formed by injection-molding a polyacetal resin as in Example 1. In said toothbrushes, thicknesses of the block heads were 2.6, 3.0, 3.5 and 4.0 mm, and lengths from bottoms of tuft holes to reverse surfaces of the block heads were as shown in Table 4. These toothbrushes were subjected to the embedding test as in Example 1. In this test, abnormality and an embedding property of the toothbrush block head were evaluated. The results of the evaluation are shown in Table 4.

In Table 4, T is a thickness (mm) of the block head in the toothbrush, and L is a length (mm) from the bottoms of the tuft holes to the reverse surface of the block head. The evaluation is based on grades, 0, $X_a$, and $X_b$ as described below.

0: Abnormality does not occur on the block head of the toothbrush and the embedding property is good.

$X_a$: The block head of the toothbrush is cracked or whitened by embedding, and there is thus a problem in practice.

$X_b$: The flat bars cannot be fixed in the tuft holes, or even if the flat bars can be fixed therein, bristles easily fall out, or uneven standing of the bristles occurs, providing undesirous appearance.

TABLE 4

| | L (mm) | | | | | | | |
|---|---|---|---|---|---|---|---|---|
| T (mm) | 0.16 | 0.2 | 0.6 | 1.0 | 1.4 | 1.8 | 2.2 | 2.3 |
| 2.6 | xa | xa | xa | xb | xb | xb | xb | xb |
| 3.0 | xa | o | o | o | xb | xb | xb | xb |
| 3.5 | xa | o | o | o | o | xb | xb | xb |
| 4.0 | xa | o | o | o | o | o | o | xb |

The results of Table 4 prove that the length from the bottoms of the tuft holes to the reverse surface of the block head in the toothbrush has to be 0.2 mm or more and the depth of the tuft holes 1.8 or more, respectively.

Effects of the Invention

Since the polyacetal resin is used as the material of the handle in the toothbrush of this invention, the block head of the toothbrush is not broken nor cracked in embedding even when the block head is thinned. Consequently, this invention has enabled production of the toothbrush having the block head which is thinner than as usual. Resiliency of the material has made the use of the toothbrush in the mouth more convenient, provided good handleability in brushing that could not be given with ordinary toothbrushes, and improved the effect of cleaning the mouth. Particularly, it has become possible to clean relatively easily the inside surfaces of the molars that could not be cleaned well with the ordinary toothbrushes. Further, owing to the high mechanical strength, the handle is not broken nor destroyed even when a strong force is applied in brushing, and safety is secured even if the neck portion is elongated. Still further, owing to the excellent chemical resistance, the material is not deteriorated by a flavor in the dentifrice, or the like even if the toothbrush is used along with the dentifrice. Furthermore, owing to the excellent heat resistance, the heat sterilization is possible which is hygienically desirous.

What is claimed is:

1. A toothbrush comprising: a block head with bristles embedded in tuft holes, a block handle for holding said toothbrush, and an elongated neck portion connecting said block head with said block handle, said block head having a bottom surface, said tuft holes having corresponding bottoms, wherein said block head is at least 3 mm but at most 4 mm in thickness, said block head has a length from said bottoms of said tuft holes to said bottom surface of said block head, said length being at least 0.2 mm but at most 2.2 mm, said tuft holes are at least 1.8 mm but at most 3.8 mm in depth, and said block head, block handle and elongated neck portion are formed of a polyacetal resin.

2. The toothbrush of claim 1 wherein said block head is at least 3.1 mm but at most 3.8 mm in thickness, and said depth of said tuft holes is at most 3.6 mm.

3. The toothbrush of claim 2 wherein said length is at least 0.25 mm but at most 1.8 mm.

4. The toothbrush of claim 1 wherein said length is at least 0.25 mm but at most 1.8 mm, and said depth of said tuft holes is at most 3.75 mm.

* * * * *

UNITED STATES PATENT AND TRADEMARK OFFICE

CERTIFICATE OF CORRECTION

PATENT NO. : 5,797,158
DATED : August 25, 1998
INVENTOR(S) : Hisakata Hoshizaki, et. al.

It is certified that error appears in the above-identified patent and that said Letters Patent is hereby corrected as shown below:

Title page, [30], under Priority data, insert --
Nov. 22, 1993 [JP] Japan.....5-313960--

Signed and Sealed this

Sixteenth Day of February, 1999

*Attest:*

*Attesting Officer*

*Acting Commissioner of Patents and Trademarks*